US009593603B2

(12) United States Patent
Berndt

(10) Patent No.: US 9,593,603 B2
(45) Date of Patent: Mar. 14, 2017

(54) CAMSHAFT PHASE ADJUSTER INCLUDING A CAMSHAFT WITH HELICAL GROOVES

(71) Applicant: Schaeffler Technologies AG & Co. KG, Herzogenaurach (DE)

(72) Inventor: Eric Berndt, Whitefish Bay, WI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 20 days.

(21) Appl. No.: 14/619,752

(22) Filed: Feb. 11, 2015

(65) Prior Publication Data

US 2016/0230616 A1 Aug. 11, 2016

(51) Int. Cl.

| | |
|---|---|
| ***F01L 1/34*** | (2006.01) |
| ***F01L 1/352*** | (2006.01) |
| ***F01L 1/047*** | (2006.01) |
| ***F01L 9/04*** | (2006.01) |
| ***F01L 9/02*** | (2006.01) |

(52) U.S. Cl.

CPC ..... *F01L 1/352* (2013.01); *F01L 1/047* (2013.01); *F01L 9/02* (2013.01); *F01L 9/04* (2013.01)

(58) Field of Classification Search

CPC ... F01L 1/34; F01L 1/344; F01L 1/047; F01L 1/352; F01L 9/02; F01L 9/04

USPC ..... 123/90.16, 90.17, 90.18

See application file for complete search history.

(56) References Cited

U.S. PATENT DOCUMENTS

| | | | | |
|---|---|---|---|---|
| 7,669,566 | B2 | 3/2010 | Methley | |
| 2012/0298059 | A1* | 11/2012 | Yang | F01L 1/344 123/90.15 |
| 2013/0074793 | A1* | 3/2013 | Washino | F01L 1/344 123/90.17 |

* cited by examiner

*Primary Examiner* — Ching Chang

(74) *Attorney, Agent, or Firm* — Volpe and Koenig, P.C.

(57) ABSTRACT

A camshaft phase adjuster assembly is provided that includes at least one helical groove for adjusting a phase position between a camshaft and a drive sprocket. The camshaft phase adjuster assembly includes a camshaft including at least one helical groove extending between a bore and a radially outer surface of a sprocket support portion, and the helical groove includes circumferentially offset first and second ends. A drive sprocket includes at least one axially extending drive sprocket groove on a radially inner surface of the drive sprocket arranged facing the at least one helical groove. An actuator selectively moves an actuator pin axially such that a radially extending rotation pin slides within the helical groove and the drive sprocket groove from a first phase position to a second phase position.

16 Claims, 5 Drawing Sheets

CAMSHAFT PHASE ADJUSTER INCLUDING A CAMSHAFT WITH HELICAL GROOVES

FIELD OF INVENTION

The present invention relates to a camshaft phase adjuster, and is more particularly related to an actuator for a camshaft phase adjuster.

BACKGROUND

Camshaft phase adjusters are used to either advance or retard the phase of a camshaft with respect to a crankshaft to alter the intake and exhaust stroke timing of the corresponding valves. Known camshaft phase adjuster assemblies include a variety of actuators, such as hydraulic or electric actuators, to adjust the phase of the camshaft. Hydraulic camshaft phase adjusters require hydraulic fluid to be supplied to multi-way valves, and complex arrangements of pressurized channels with sliding seals, and these components increase the cost as well as the overall space requirements for an engine assembly. These known hydraulic camshaft phase adjusters also require complex control components to precisely supply and drain hydraulic fluid to advance and retard the camshaft timing. It would be desirable to provide a simplified camshaft phase adjuster for use in smaller engine applications, e.g. motorcycles, ATVs, and recreational boats, that does not require the large space requirements and/or the complex control components of the known hydraulic camshaft phase adjusters.

SUMMARY

A camshaft phase adjuster assembly is provided with an integral actuator that engages helical grooves formed on a camshaft for adjusting a phase position between a camshaft and a drive sprocket. The camshaft phase adjuster assembly includes a camshaft having a sprocket support portion, a bore extending axially in the sprocket support portion, and at least one helical groove extending between the bore and a radially outer surface of the sprocket support portion. The helical groove includes circumferentially offset first and second ends. The camshaft phase adjuster assembly includes a drive sprocket having an opening that is supported on the sprocket support portion of the camshaft, and an axially extending drive sprocket groove on a radially inner surface of the drive sprocket arranged facing the helical groove. The camshaft phase adjuster assembly includes an actuator pin having a first end and a second end. The first end of the actuator pin is arranged within the bore of the camshaft and includes a radially extending rotation pin. The radially extending rotation pin is engaged with the helical groove and the drive sprocket groove. An actuator is connected to the second end of the actuator pin that selectively moves the actuator pin axially within the bore of the camshaft. The axial movement of the actuator slides the radially extending rotation pin within the helical groove and the drive sprocket groove from (1) a first position in which the camshaft and the drive sprocket are rotated relative to each other to a first phase position, to (2) a second position in which the camshaft and the drive sprocket are rotated relative to each other to a second phase position.

Additional embodiments are described below and in the claims.

BRIEF DESCRIPTION OF THE DRAWINGS

The foregoing Summary and the following detailed description will be better understood when read in conjunction with the appended drawings, which illustrates a preferred embodiment of the invention. In the drawings.

DETAILED DESCRIPTION OF THE PREFERRED EMBODIMENTS

Figure 1:
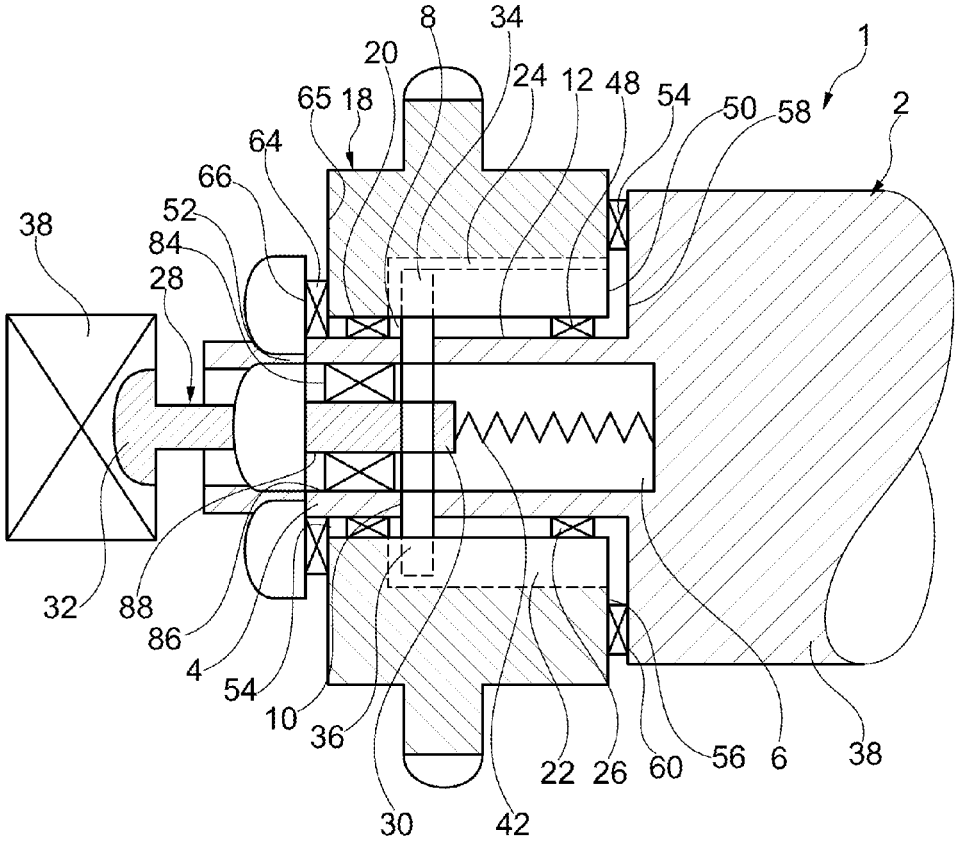
FIG. 1 shows a partial cross-sectional view of camshaft phase adjuster according to one embodiment of the invention.

Certain terminology is used in the following description for convenience only and is not limiting. The words "front," "rear," "upper," and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
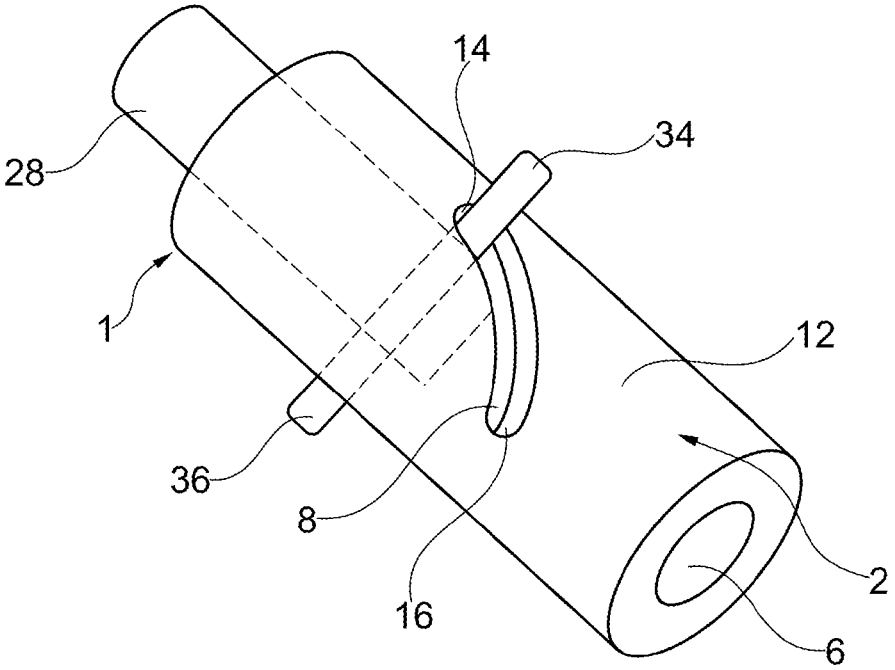
FIG. 2 shows a partial perspective view of a camshaft for the camshaft phase adjuster according to one embodiment of the invention.

As shown in FIG. 1, a camshaft phase adjuster assembly 1 is provided. As shown in FIGS. 1 and 2, the camshaft phase adjuster assembly 1 includes a camshaft 2 having a sprocket support portion 4, a bore 6 extending axially in the sprocket support portion 4, and at least one, and preferably two helical grooves 8, 10 extending between the bore 6 and a radially outer surface 12 of the sprocket support portion 4. Each of the two helical grooves 8, 10 includes circumferentially offset first and second ends 14, 16. In one preferred embodiment, a circumferential offset (θ) between the first and second ends 14, 16 of each of the helical grooves 8, 10 is 30°. One of ordinary skill in the art will recognize that the circumferential offset (θ) can vary, depending on the desired phase adjustment. In one embodiment, the camshaft 2 includes a body portion 38 defining a cam 40, and the sprocket support portion 4 has a smaller outer diameter than an outer diameter of the body portion 38.

Figure 3:
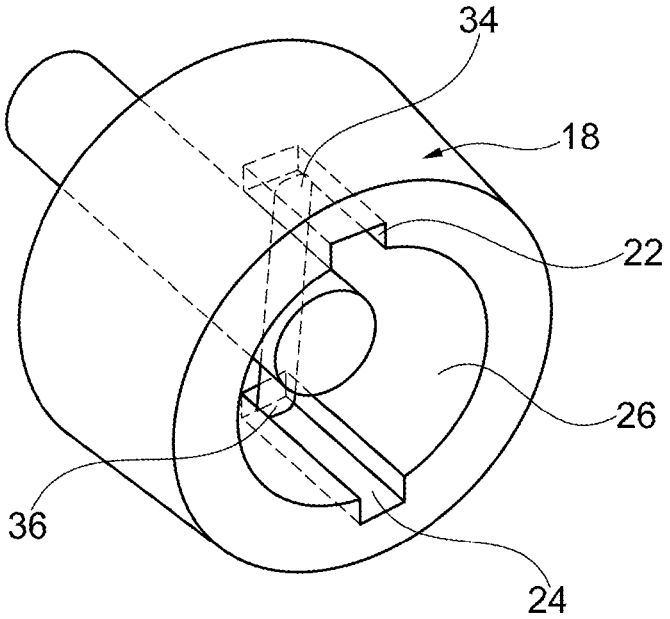
FIG. 3 shows a partial perspective view of a drive sprocket for the camshaft phase adjuster according one embodiment of the invention.

As shown in FIGS. 1 and 3, the camshaft phase adjuster assembly 1 also includes a drive sprocket 18 having an opening 20 that is supported on the sprocket support portion 4 of the camshaft 2, and at least one, and more preferably two axially extending drive sprocket grooves 22, 24 on a radially inner surface 26 of the drive sprocket 18 arranged facing the two helical grooves 8, 10. The drive sprocket 18 is connected to a crankshaft via a chain (not shown). In one embodiment, the two drive sprocket grooves 22, 24 are arranged 180° circumferentially apart from each other.

The camshaft phase adjuster assembly 1 includes an actuator pin 28 having a first end 30 and a second end 32, and the first end 30 is arranged within the bore 6 of the camshaft 2 and includes at least one, and preferably two radially extending rotation pins 34, 36. Each of the two radially extending rotation pins 34, 36 is engaged with a respective one of the helical grooves 8, 10 and a respective one of the drive sprocket grooves 22, 24. In one embodiment, the two radially extending rotation pins 34, 36 are arranged 180° circumferentially apart from each other. Alternatively, a single rotation pin 34 can be used that extends through one helical groove 8 into one drive sprocket groove 22. One of ordinary skill in the art recognizes that more than two rotation pins can be included on the actuator pin 28.

Figure 5:
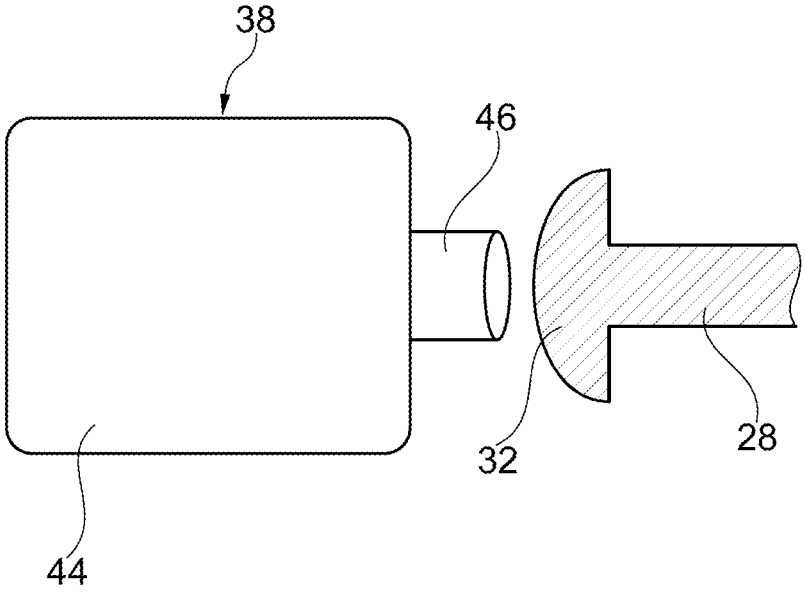
FIG. 5 shows a magnified view of a solenoid actuator for a camshaft phase adjuster according to one embodiment of the invention.

The camshaft phase adjuster assembly 1 also includes an actuator 38 that is connected to the second end 32 of the actuator pin 28 that selectively moves the actuator pin 28 axially within the bore 6 of the camshaft 2. One of ordinary skill will recognize that the actuator 38 can be an electrical, mechanical, hydraulic, or centrifugal actuator. Due to the axial movement from the actuator 38, the radially extending rotation pins 34, 36 slide within the helical grooves 8, 10 and the drive sprocket grooves 22, 24 from (1) a first position in which the camshaft 2 and the drive sprocket 18 are located relative to each other in a first phase position, to (2) a second position in which the camshaft 2 and the drive sprocket 18 are rotated relative to each other to a second phase position. In one embodiment, the first phase position corresponds to a retarded phase position and the second phase position corresponds to an advanced phase position. A spring 42 is preferably arranged between the first end 30 of the actuation pin 28 and the camshaft 2 that biases the actuation pin 28 to the first phase position. In one embodiment, the actuator 38 moves the actuation pin 28 to an intermediate position in which the camshaft 2 and the drive sprocket 18 are rotated relative to each other to a third phase position. In a preferred embodiment, the intermediate position corresponds to a neutral phase position, and the timing is neither retarded nor advanced. As shown in FIG. 5, in one embodiment the actuator 38 includes a solenoid 44 with a solenoid pin 46 that engages the actuator pin 28, and the solenoid 44 is capable of continuous positioning between first and second phase positions. One of ordinary skill in the art recognizes that the solenoid 44 can be capable of continuous position between more than two phase positions.

In one embodiment, a plurality of rolling bearings are provided to support the drive sprocket 18 and camshaft 2. As shown in FIG. 1, a first radial rolling bearing 48 is supported between the radially inner surface 26 of the drive sprocket 18 and the sprocket support portion 4 of the camshaft 2 at a first axial end 50 of the drive sprocket 18, and a second radial rolling bearing 52 is supported between the radially inner surface 26 of the drive sprocket 18 and the sprocket support portion 4 of the camshaft 2 at a second axial end 54 of the drive sprocket 18. In one embodiment, the first and second radial rolling bearings 48, 52 include spherical rolling elements or needle rolling elements. A first axial rolling bearing 54 is supported between a first axial end 56 face of the drive sprocket 18 and an axial end face 58 of a shoulder 60 defined by the body portion 38 of the camshaft 2 adjacent to the sprocket support portion 4, and a second axial rolling bearing 64 is supported between a second axial end face 65 of the drive sprocket 18 and a retention flange 66. The first and second axial rolling bearings 54, 64 preferably include needle rolling elements. The retention flange 66 is fixed to the camshaft 2. One of ordinary skill in the art will recognize that the retention flange 66 can be an axial face of a securing nut or a washer held by the securing nut. In one embodiment, a combined axial and radial bearing 84 is supported between a radially inner surface 86 of the sprocket support portion 4 of the camshaft 2 and a radially outer surface 88 of the actuator 28. Although the embodiments of the bearings above are described as rolling bearings, one of ordinary skill in the art recognizes that plain bearings without rolling elements can be used to support the camshaft 2, drive sprocket 18, and actuator pin 28 with respect to each other.

Figure 4:
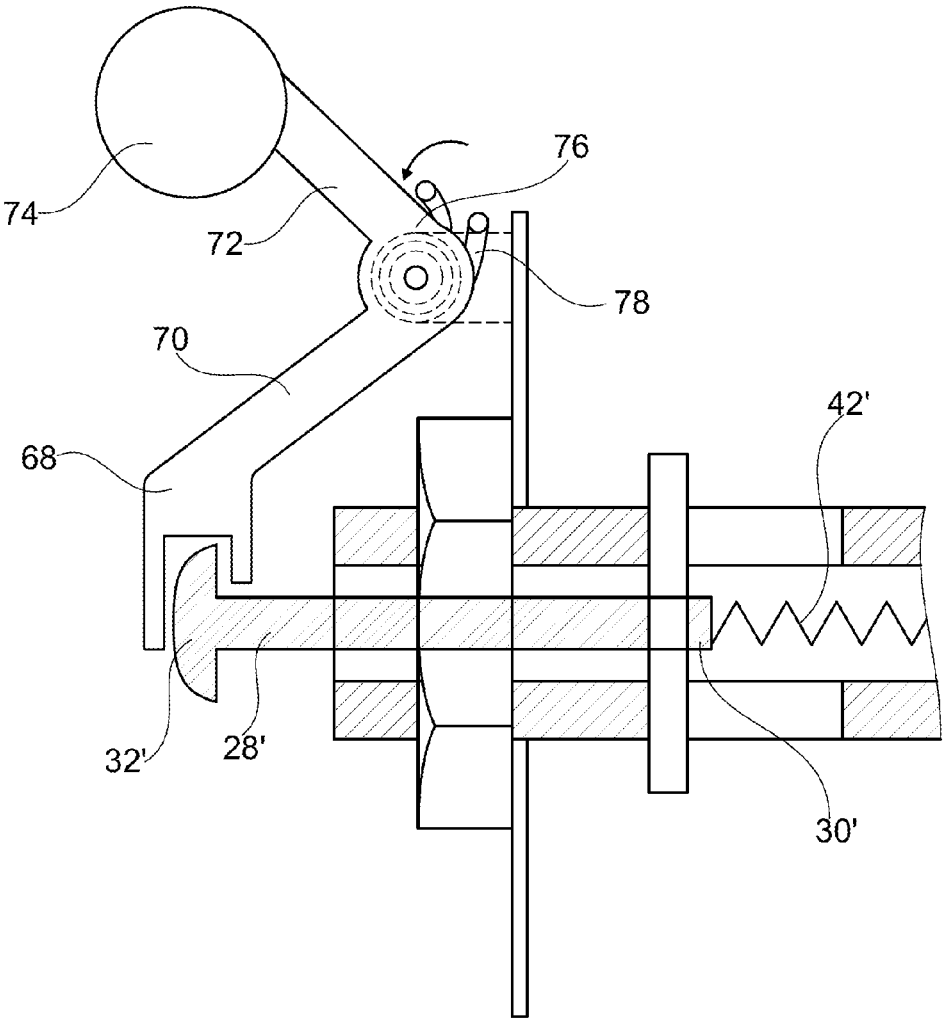
FIG. 4 shows a partial cross-sectional view of another embodiment of a camshaft phase adjuster according to the invention.

In another embodiment shown in FIG. 4, a second end 32' of the actuator pin 28' is engaged by a first leg 68 of at least one lever arm 70. A second leg 72 of the lever arm 70 includes a mass 74, and a middle portion 76 of the lever arm 70 is mounted on a retention flange or engine component with a leg spring 78 that biases the first leg 68 to push the actuator pin 28' to the first position. Two or more of the lever arms 70 are preferably provided. During rotation of the camshaft 2, centrifugal forces are generated by the mass 74 that push the first leg 68 in an opposite direction from the spring bias to move the actuator pin 28' to a second position. In a preferred embodiment, the first position corresponds to a retarded position and the second position corresponds to an advanced position. In one embodiment, a spring 42' is arranged between the first end 30' of the actuation pin 28' and the camshaft 2 and provides an additional force to push the actuator pin 28' to the second position.

Figure 6A:
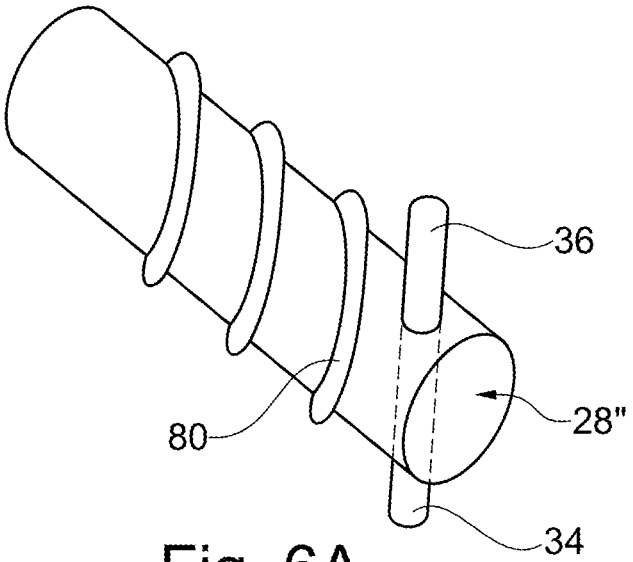
FIGS. 6A and 6B show an actuator pin and camshaft including a threading according to one embodiment of the invention.
Figure 6B:
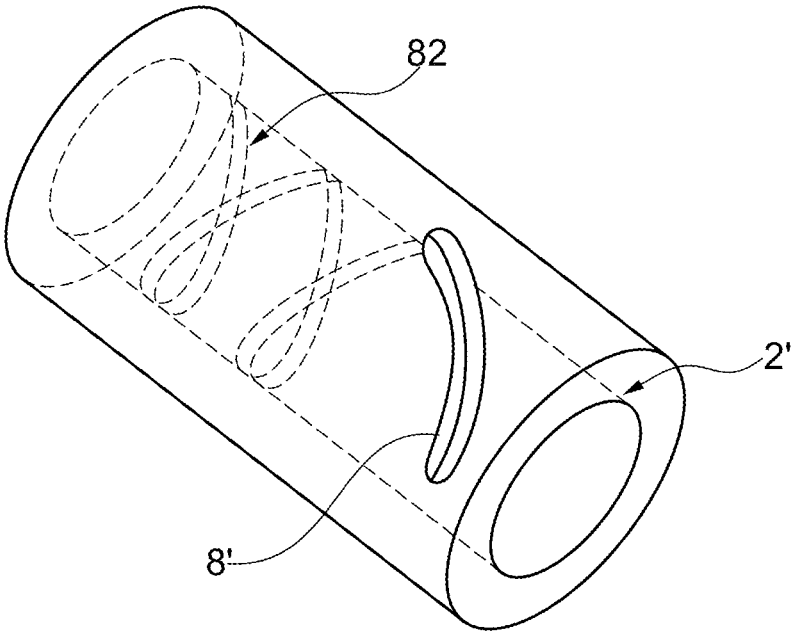

In another embodiment shown in FIGS. 6A and 6B, the actuator pin 28" includes an external helical thread 80 and the camshaft 2' includes at least one helical groove 8' and an internal helical thread 82 that corresponds to the external helical thread 80. This embodiment is similar to the embodiment described above with respect to the movement of the actuator pin 28", and the phase adjustment between the camshaft 2' and the drive sprocket 18. The axial movement of the actuator pin 28" is converted into rotary motion via the internal and external helical threads 80, 82. The internal and external threads 80, 82 guide the actuator pin 28" as the actuator pin 28" axially moves within the camshaft 2', and a clearance is provided between the rotation pins 34, 36 and the helical groove 8' during the sliding movement of the actuator pin 28".

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A camshaft phase adjuster assembly comprising:

a camshaft including a sprocket support portion, a bore extending axially in the sprocket support portion, and at least one helical groove extending between the bore and a radially outer surface of the sprocket support portion, the at least one helical groove includes circumferentially offset first and second ends;

a drive sprocket including an opening that is supported on the sprocket support portion of the camshaft and at least one axially extending drive sprocket groove on a radially inner surface of the drive sprocket arranged facing the at least one helical groove;

an actuator pin including a first end and a second end, the first end is arranged within the bore of the camshaft and includes at least one radially extending rotation pin, the radially extending rotation pin is engaged with the at least one helical groove and the at least one drive sprocket groove; and an actuator connected to the second end of the actuator pin that selectively moves the actuator pin axially within the bore of the camshaft such that the at least one radially extending rotation pin slides within the at least one helical groove and the at least one drive sprocket groove from (1) a first position in which the camshaft and the drive sprocket are located relative to each other in a first phase position, to (2) a second position in which the camshaft and the drive sprocket are rotated relative to each other to a second phase position.

2. The camshaft phase adjuster assembly of claim 1, wherein the at least one helical groove includes two helical grooves, the at least one drive sprocket groove includes two drive sprocket grooves, and the at least one radially extending rotation pin include two rotation pins.

3. The camshaft phase adjuster assembly of claim 2, wherein the two radially extending rotation pins are arranged 180° circumferentially apart from each other, and the two drive sprocket grooves are arranged 180° circumferentially apart from each other.

4. The camshaft phase adjuster assembly of claim 1, wherein the camshaft includes a body portion defining a cam, and the sprocket support portion has a smaller outer diameter than the body portion.

5. The camshaft phase adjuster assembly of claim 1, further comprising a spring arranged directly between the first end of the actuation pin and the camshaft that biases the actuation pin to the first position.

6. The camshaft phase adjuster assembly of claim 1, wherein the first phase position corresponds to a retarded phase position.

7. The camshaft phase adjuster assembly of claim 1, wherein the second phase position corresponds to an advanced phase position.

8. The camshaft phase adjuster assembly of claim 1, wherein a circumferential offset between the first and second ends of the at least one helical groove is 30°.

9. The camshaft phase adjuster assembly of claim 1, wherein the actuator is an electrical, mechanical, hydraulic, or centrifugal actuator.

10. The camshaft phase adjuster assembly of claim 1, wherein the actuator includes a solenoid with a solenoid pin that engages the actuator pin, and the solenoid is a two-position, a three-position, or a continuously variable solenoid.

11. The camshaft phase adjuster assembly of claim 1, further comprising a first radial rolling bearing supported between the radially inner surface of the drive sprocket and the sprocket support portion of the camshaft at a first axial end of the drive sprocket, and a second radial rolling bearing supported between the radially inner surface of the drive sprocket and the sprocket support portion of the camshaft at a second axial end of the drive sprocket.

12. The camshaft phase adjuster assembly of claim 1, further comprising a first axial rolling bearing supported between a first axial end face of the drive sprocket and an axial end face of a shoulder defined by a body portion of the camshaft adjacent to the sprocket support portion, and a second axial rolling bearing supported between a second axial end face of the drive sprocket and a retention flange, wherein the retention flange is fixed to the camshaft.

13. The camshaft phase adjuster assembly of claim 12, wherein the retention flange is an axial face of a securing nut or a washer held by the securing nut.

14. The camshaft phase adjuster assembly of claim 1, wherein the actuator moves the actuation pin to an intermediate position in which the camshaft and the drive sprocket are rotated relative to each other to a third phase position.

15. The camshaft phase adjuster assembly of claim 14, wherein the intermediate position corresponds to a neutral phase position.

16. A camshaft phase adjuster assembly comprising:

a camshaft including a sprocket support portion and at least one first phase adjustment element on a radially outer surface of the sprocket support portion;

a drive sprocket including an opening that is supported on the sprocket support portion of the camshaft and at least one second phase adjustment element on a radially inner surface of the drive sprocket arranged facing the at least one first phase adjustment element;

an actuator pin including a first end and a second end, the first end is engaged with the camshaft; and an actuator connected to the second end of the actuator pin that selectively moves the actuator pin such that the at least one first and second phase adjustment elements move relative to one another from (1) a first position in which the camshaft and the drive sprocket are located relative to each other in a first phase position, to (2) a second position in which the camshaft and the drive sprocket are rotated relative to each other to a second phase position.

* * * * *